US007832909B2

(12) United States Patent
Wang

(10) Patent No.: US 7,832,909 B2
(45) Date of Patent: Nov. 16, 2010

(54) COMBINATIONAL INSET LAMP EXEMPT FROM A SHIELDING CYLINDER

(75) Inventor: Robert Wang, Taoyuan County (TW)

(73) Assignee: Ceramate Technical Co., Ltd., Taoyuan (TW)

( * ) Notice: Subject to any disclaimer, the term of this patent is extended or adjusted under 35 U.S.C. 154(b) by 286 days.

(21) Appl. No.: 12/247,357

(22) Filed: Oct. 8, 2008

(65) Prior Publication Data

US 2010/0085765 A1 Apr. 8, 2010

(51) Int. Cl.
*F21V 1/02* (2006.01)

(52) U.S. Cl. ..... 362/364; 362/147; 362/148; 362/373

(58) Field of Classification Search ..... 362/147, 362/148, 153, 153.1, 183, 184, 190, 200–202, 362/204, 227, 236, 240, 249.01, 249.02, 362/294, 364, 365, 373, 433, 440, 455, 800
See application file for complete search history.

(56) References Cited

U.S. PATENT DOCUMENTS 4,754,377 A * 6/1988 Wenman ..... 362/148
7,396,146 B2 * 7/2008 Wang ..... 362/294
7,458,706 B1 * 12/2008 Liu et al. ..... 362/373
7,524,089 B2 * 4/2009 Park ..... 362/294

* cited by examiner

*Primary Examiner*—Hargobind S Sawhney
(74) *Attorney, Agent, or Firm*—Ming Chow; Sinorica, LLC

(57) ABSTRACT

A combinational inset lamp exempt from a shielding cylinder comprises a light-source body. The light-source body is covered by an insulation cover. An extension cover replaceable is provided at the top of insulation cover. An outer disk cover spirally removable and replaceable is provided outwards and transversally around the outer circumference of the lower part of insulation cover. At least opposite two sides of the outer circumferential wall of insulation cover are respectively formed outwards with an elastic clamping flake. The elastic clamping flake is removable and flexible so that the outer disk cover and the elastic clamping flake may work with each other to directly wedge the lamp onto the ceiling. Thus, the lamp that may be provided without any shielding cylinder is removable and replaceable conveniently for achievement of the advantages of carbon decrease, energy saving, and environmental protection.

10 Claims, 8 Drawing Sheets

COMBINATIONAL INSET LAMP EXEMPT FROM A SHIELDING CYLINDER

BACKGROUND OF THE INVENTION

1. Field of the Invention

This invention relates to a combinational recessed lamp exempt from a shielding cylinder.

2. Description of the Related Art

An inset lamp is a lamp installed on the ceiling, and a luminous source, such as a tungsten lamp, an energy-saving light bulb, or a LED lamp, is provided in a shielding cylinder. The lamp is recessed into the ceiling, so it looks artistic and doesn't hurt people's eyes, thereby being widely used for indoor illumination. However, despite being the tungsten lamp, the energy-saving light bulb, or the LED lamp, the recessed lamp must work with the shielding cylinder and may thus be arranged on the ceiling, and the cost increases and the materials of shielding cylinder are wasted.

Consequently, because of the technical defects of described above, the applicant keeps on carving unflaggingly through wholehearted experience and research to develop the present invention, which can effectively improve the defects described above.

SUMMARY OF THE INVENTION

This invention relates to a combinational recessed lamp exempt from a shielding cylinder that may be embed into an inset hole on the ceiling and comprises a light-source body. The light-source body is covered by an insulation cover. An outer disk cover is provided stretching outwards and transversally from the outer circumference of a lower part of the insulation cover. Further, at least opposite two sides of the outer circumferential wall of insulation cover that are respectively provided outwards with an elastic clamping flake that is removable. With the above-mentioned structure, the outer disk cover and the elastic clamping flake that work with each other may be used to directly wedge the lamp according to this invention onto the ceiling. Thus, the lamp that may be provided without any shielding cylinder is removable and replaceable conveniently for achievement of the advantages of carbon decrease, energy saving, and environmental protection.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
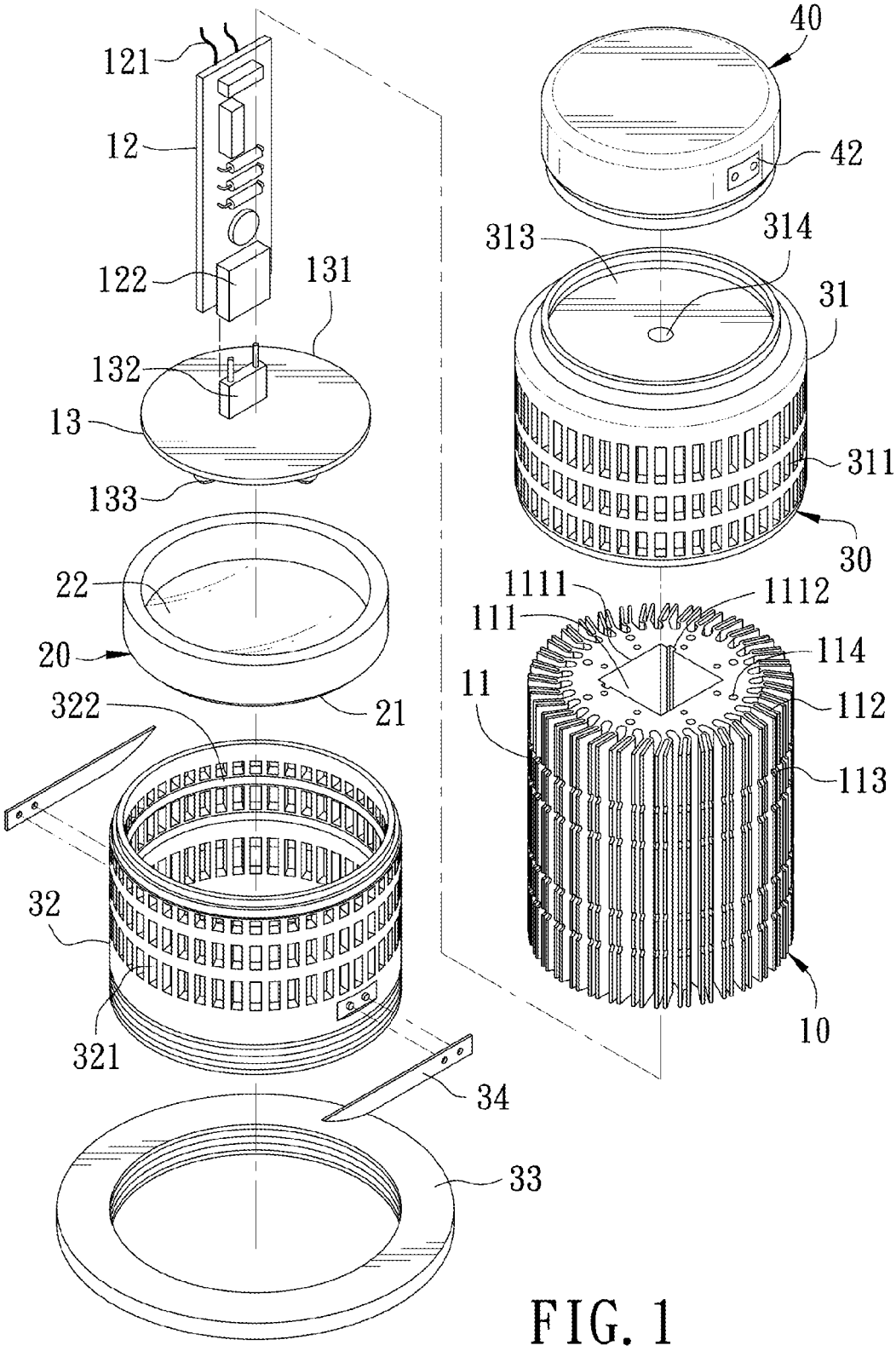
FIG. 1 is a 3D exploded view of a preferred embodiment of this invention.
Figure 2:
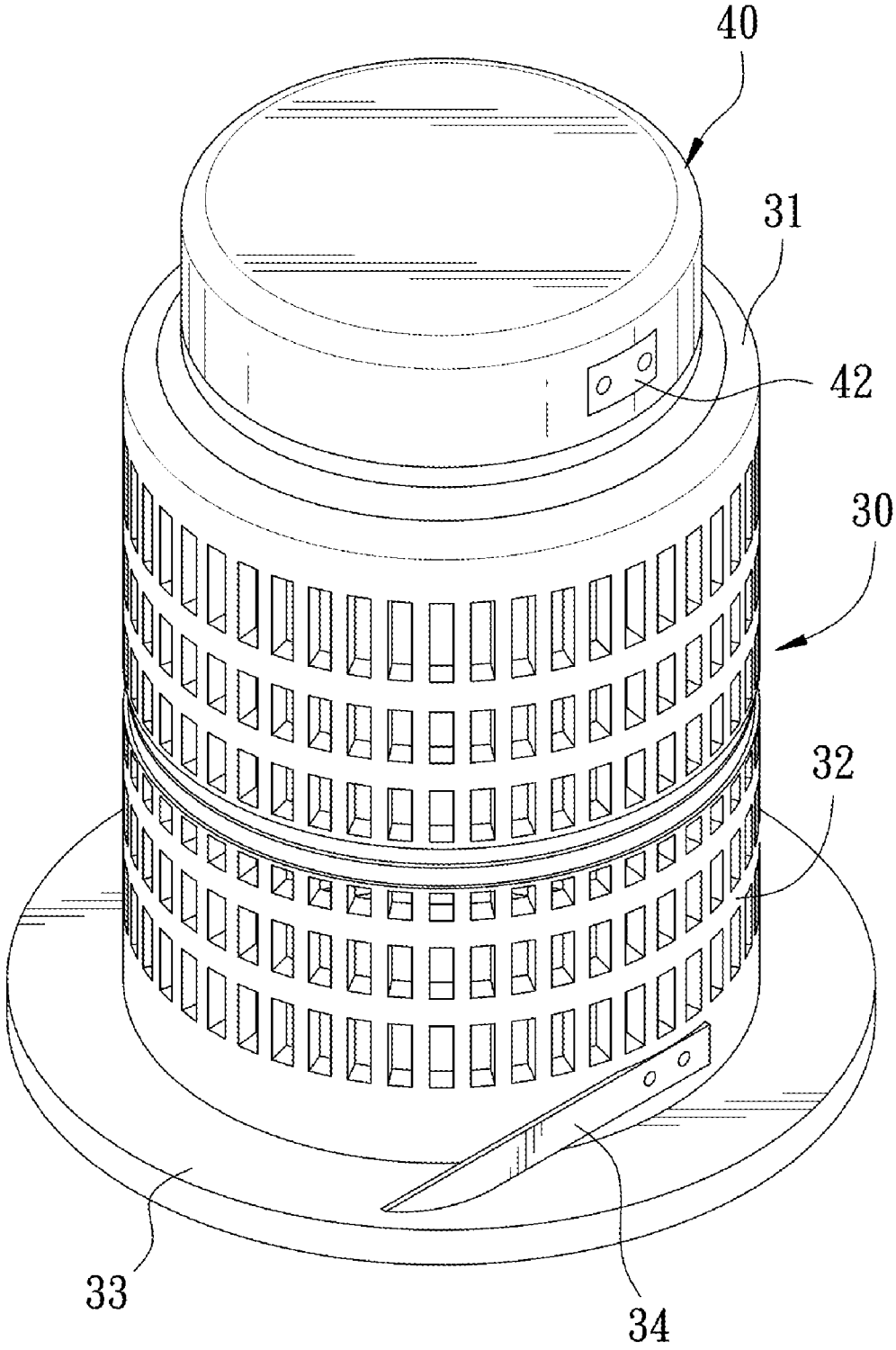
FIG. 2 is a 3D assembly view of a preferred embodiment of this invention.
Figure 3:
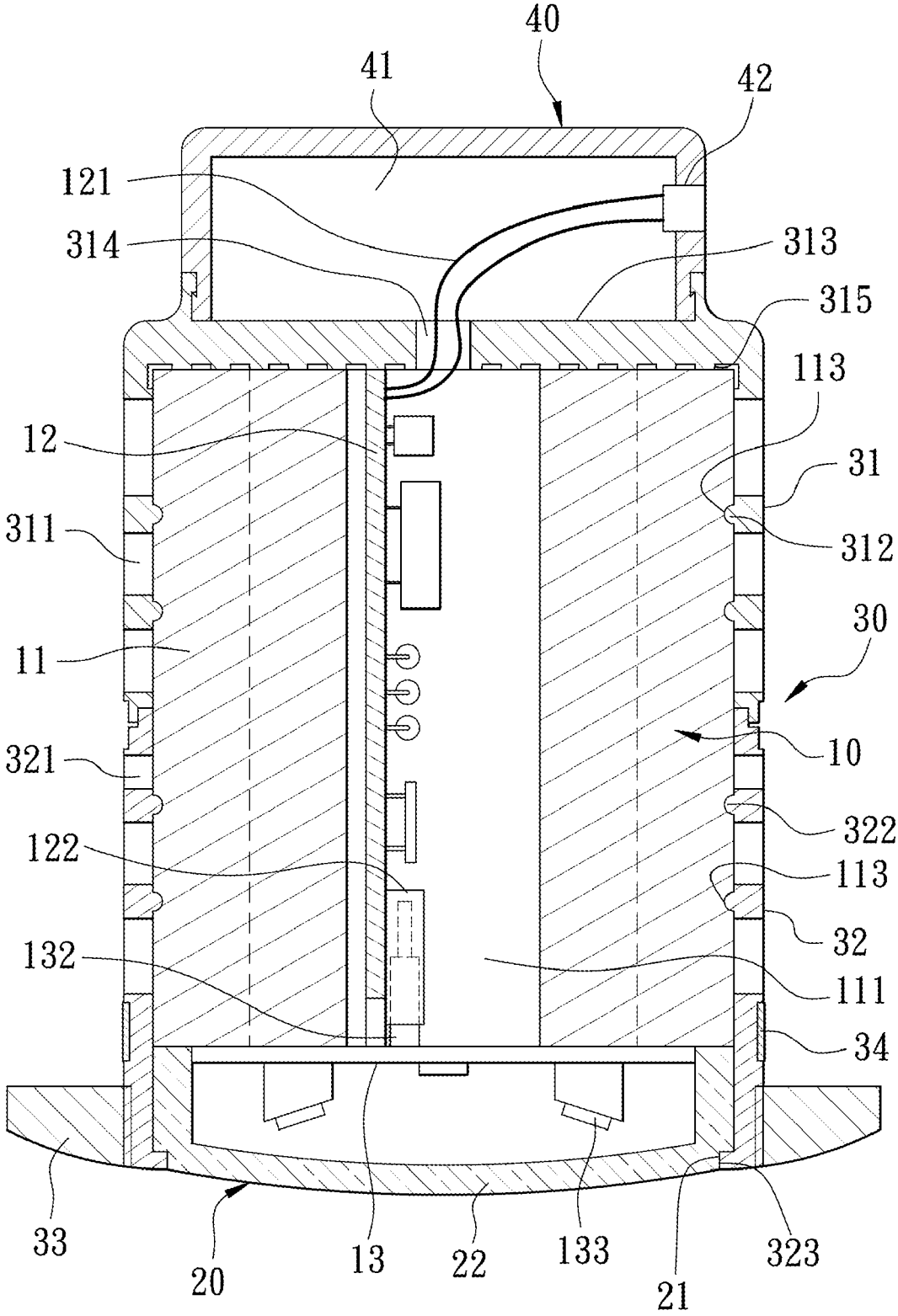
FIG. 3 is a sectional assembly view of a preferred embodiment of this invention.

Firstly, with reference to FIGS. 1 through 3 respectively shown as a 3D exploded view, a 3D assembly view, and an assembly sectional view, an inset lamp in a preferred embodiment of this invention comprises a light-source body 10, a lamp cover 20, an insulation cover 30, and an extension cover 40.

The light-source body 10 further comprises a heat dissipation part 11, a drive circuit board 12, and a LED lamp board 13.

The heat dissipation part 11 is metallic and is arranged lengthways in the form of a cylinder, and its center is formed with a rectangular thru hole 111 that is formed axially with four sidewalls 1111, in which a concave wedge slot 1112 is formed axially on the two sidewalls 1111 opposite to each other. Further, a plurality of fins 112 is formed axially around the outer circumference of heat sink part 11. A plurality of annular grooves 113 are formed in a radial direction around the outer circumference of heat dissipation part 11. Further, a plurality of convection vents 114 are axially formed in the heat dissipation part 11 around the thru hole 111 for heat convection and heat dissipation acceleration.

The drive circuit board 12 may be lengthways mounted into the thru hole 111 of heat dissipation part 11, and a power cord 121 is provided at an upper side and an insertion slot 122 is formed at a lower side.

The LED lamp board 13 is arranged transversally on a side below the heat dissipation part 11 and comprises a substrate 131. The LED lamp board 13 on the top side of substrate 131 is provided with a plug 132 to connect to the insertion slot 122 of drive circuit board 12. Besides, a plurality of LEDs 133 are provided on the bottom side of substrate 131 of the LED lamp board 13.

The lamp cover 20 is arranged below the LED lamp board 13 and is formed into a mouth facing upwards; it is a round cover formed with an annulus wall and allows light transmission; a shoulder region 21 is formed around the outer circumference of root edge of the cover 20. Further, an optics curved surface 22 is formed at the bottom side of lamp cover 20 so that the cover 20 may be replaced with a proper lamp cover 20 having the optics curved surface 22 upon an actual demand.

The insulation cover 30 may wrap around the heat dissipation part 11 for fear of touch with the metallic heat dissipation part 11. In the embodiment, the insulation cover 30 is further assembled with an upper insulation cover 31 and a lower insulation cover 32.

The upper insulation cover 31 is in the form of a cylinder and wraps around the heat dissipation part 11 from top to bottom. Further, the circumferential wall of upper insulation cover 31 is formed in the shape of grille with a plurality of heat dissipation vent 311. A plurality of annular flanges 312 opposite to the annular grooves 113 of heat dissipation part 11 are formed at the inner wall of upper insulation cover 311 and may wedge to each other for clamping. A top plate 313 is transversally arranged at the top of insulation cover 311 that is opposite to the top side of heat dissipation part 11 to prevent the top side of heat dissipation part 11 from being exposed for achievement of insulation. An outgoing line hole 314 is formed on the top plate 313 the bottom side of which is formed with a plurality of lugs 315 to bring a plurality of air gaps between the top plate 313 and the top of heat dissipation 11 for heat dissipation.

The lower insulation cover 32 is also in the form of a cylinder and wraps around the lower section of heat dissipation part 11 from bottom to top. The circumferential wall of lower insulation cover 32 is also formed in the shape of grille with a plurality of heat dissipation vents 321. A plurality of annular flanges 32 opposite to the annular grooves 113 of heat dissipation part 11 are formed at the inner wall of lower insulation cover 322 and may wedge to each other for clamping. A convex shift limit flange 323 is provided at the shoulder region 21 of lamp cover 20 that is opposite to the root edge of inner circumferential wall of the lower insulation cover 32 to prevent the lamp cover 20 from shifting. Further, an outer disk cover 33 spirally removable and replaceable is provided outwards and transversally in the insulation cover 30 around the outer circumference of the lower part of lower insulation cover 32. Next, an elastic clamping flake 34 is provided at each of opposite two sides of the insulation cover 30 around the outer circumferential wall of lower insulation cover 32 above the outer disk cover 33. The elastic clamping flake 34 may be removable and may recover even if being deformed with an external force. A space substantially equal to the thickness of ceiling is formed between the elastic clamping flake 34 and the outer disk cover 33. Each of the elastic clamping flakes 34 is a metallic elastic flake one end of which is a fixed end fixed in the direction of tangent onto the lower insulation cover 32 and the other end of which is a free end, and the bottom of each of the elastic clamping flakes 34 is convergent from the fixed end towards the free end.

The extension cover 40 is formed into a mouth facing downwards and with a round cover having an annular wall, and may be wedged onto the top of upper insulation cover 31. A chamber 41 is provided in the extension cover 40 for members, such as rechargeable batteries (not shown). Here, the lamp according to this invention may be used for emergency. An outgoing line mount 42 is provided at one side of the extension cover 40 for a power cord 121 of the drive circuit board 12 to connect to.

Again, with reference to FIGS. 1 and 3, when the lamp according to this invention is ready for assembly, firstly, a light-emitting body 10 is assembled, the drive circuit board 12 is placed in the thru hole 111 of heat dissipation part 11, and two sides of the drive circuit board 12 is wedged into the wedge slots 1112 of heat dissipation part 11 for fixing. Then, the plug 132 of LED lamp board 13 is plugged into the insertion slot 122 of drive circuit board 12, the LED lamp board 13 is thus arranged on the bottom surface of heat dissipation part 11, and the bottom sides of LEDs 133 are made to touch the heat dissipation part 11. Then, the lamp cover 20 is placed in the lower insulation cover 32, the lower insulation cover 32 is made to wrap around the lower section of heat dissipation part 11 from bottom to top, and thus the lamp cover 20 is made to exactly cover the LED lamp board 13. Next, the upper insulation cover 31 is made to wrap around the upper section of heat dissipation part 11 from top to bottom and to wedge to the lower insulation cover 32. Next, the outer disk cover 33 is spirally fixed onto the lower insulation cover 32. Finally, the power cord 121 of drive circuit board 12 is connected to the outgoing line mount 42 of the extension cover 40 and the extension cover 40 is wedged onto the top of upper insulation cover 31, thereby the assembly procedure being finished.

Figure 4:
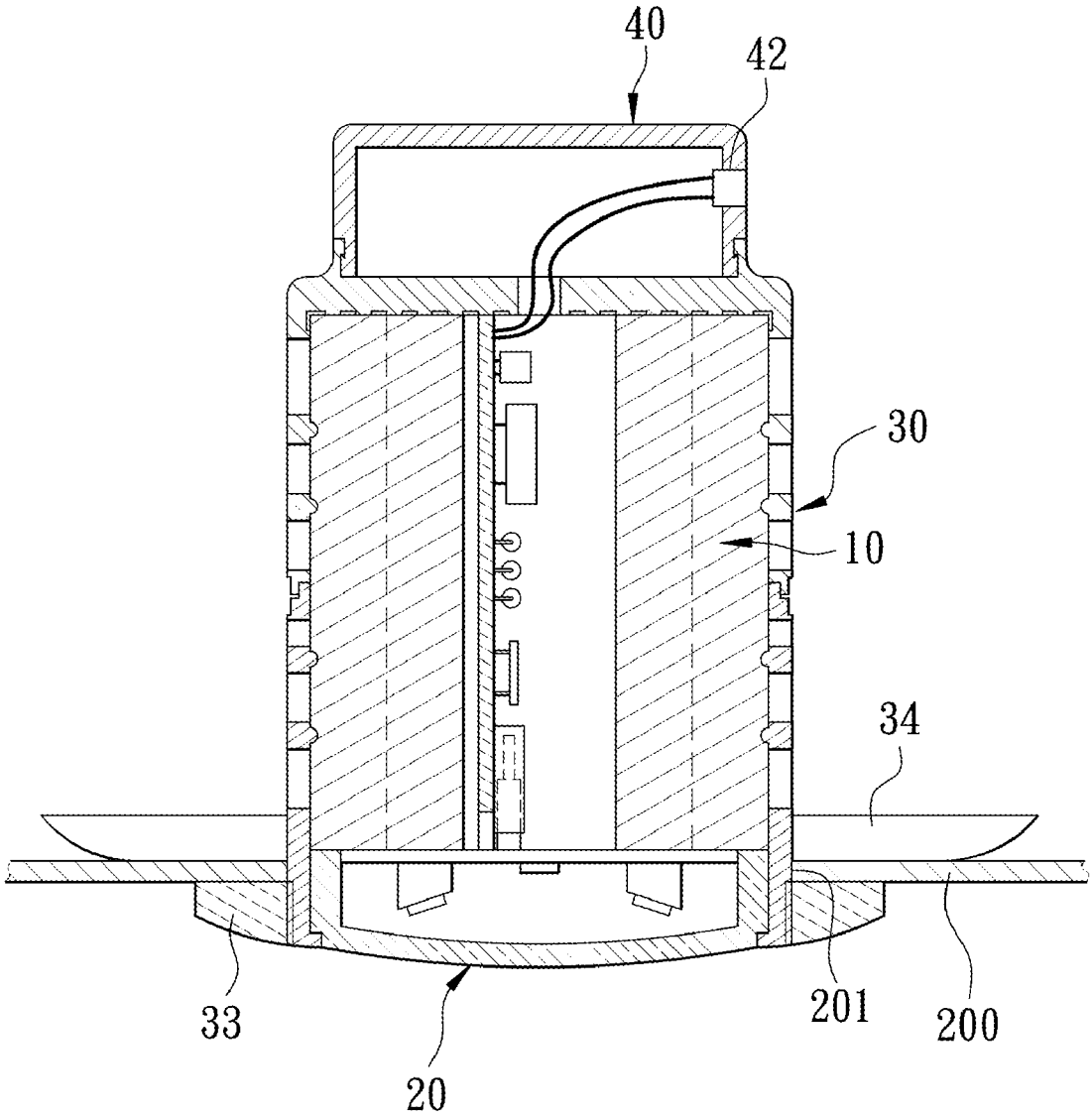
FIG. 4 is a schematic view illustrating a recessed lamp that is arranged on the ceiling in a preferred embodiment of this invention.

With reference to FIG. 4 shown as a schematic view illustrating the lamp according to this invention arranged on the ceiling, when the lamp according to this invention is installed in an inset hole 201 of the ceiling 200, the elastic clamping flake 34 of the lamp according to this invention is just bent inwards and then the lamp according to this invention is placed into the inset hole 201 of the ceiling from bottom to top. At this time, when the elastic clamping flake 34 bounces outwards, it works with the outer disk cover 33 to limit the shift of ceiling 200. Further, the area of outer disk cover 33 is definitely wide to cover the differently sized inset hole 201 of the ceiling 200, thereby the installation being finished.

Contrarily, to remove the lamp according to this invention from the inset hole 201 of the ceiling 200, the lamp according to this invention is revolved in a reverse direction only towards the free end of elastic clamping flake 34 from the top down. Being convergent, the bottom of elastic clamping flake 34 led by the inset hole 201 is bent inwards by degree until the lamp according to this invention is fully removed from the inset hole 201 of the ceiling 200, thereby the removal being finished.

Figure 5:
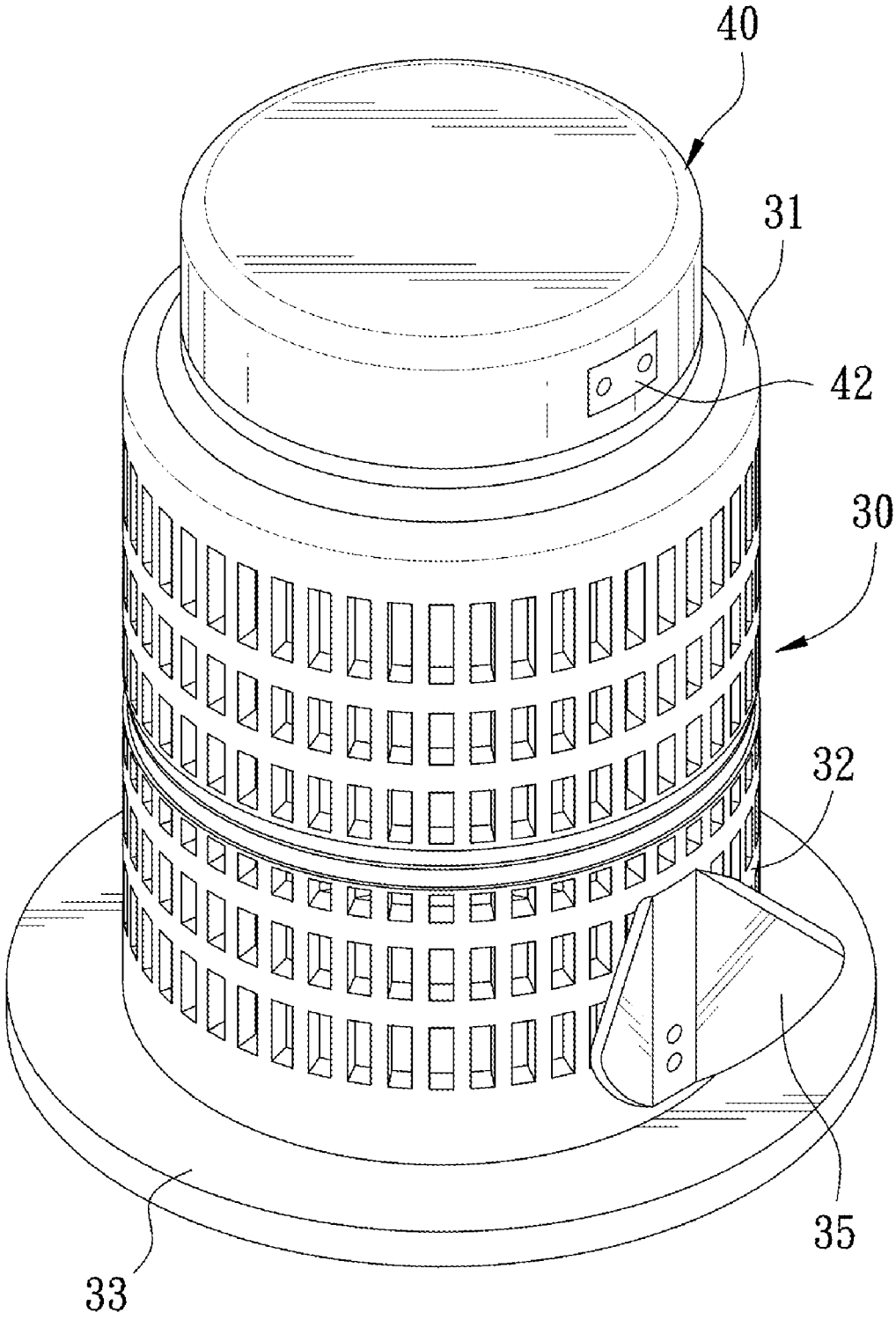
FIG. 5 is a 3D assembly view of another preferred embodiment of this invention.

With reference to FIG. 5 shown as a 3D assembly view of another preferred embodiment of this invention, the elastic clamping flake 35 according to this invention is a metallic flake in the form of a rhombus, the middle region of which is lengthways fixed onto the lower insulation cover 32 and the left and right sides of which are formed into free ends.

Figure 6:
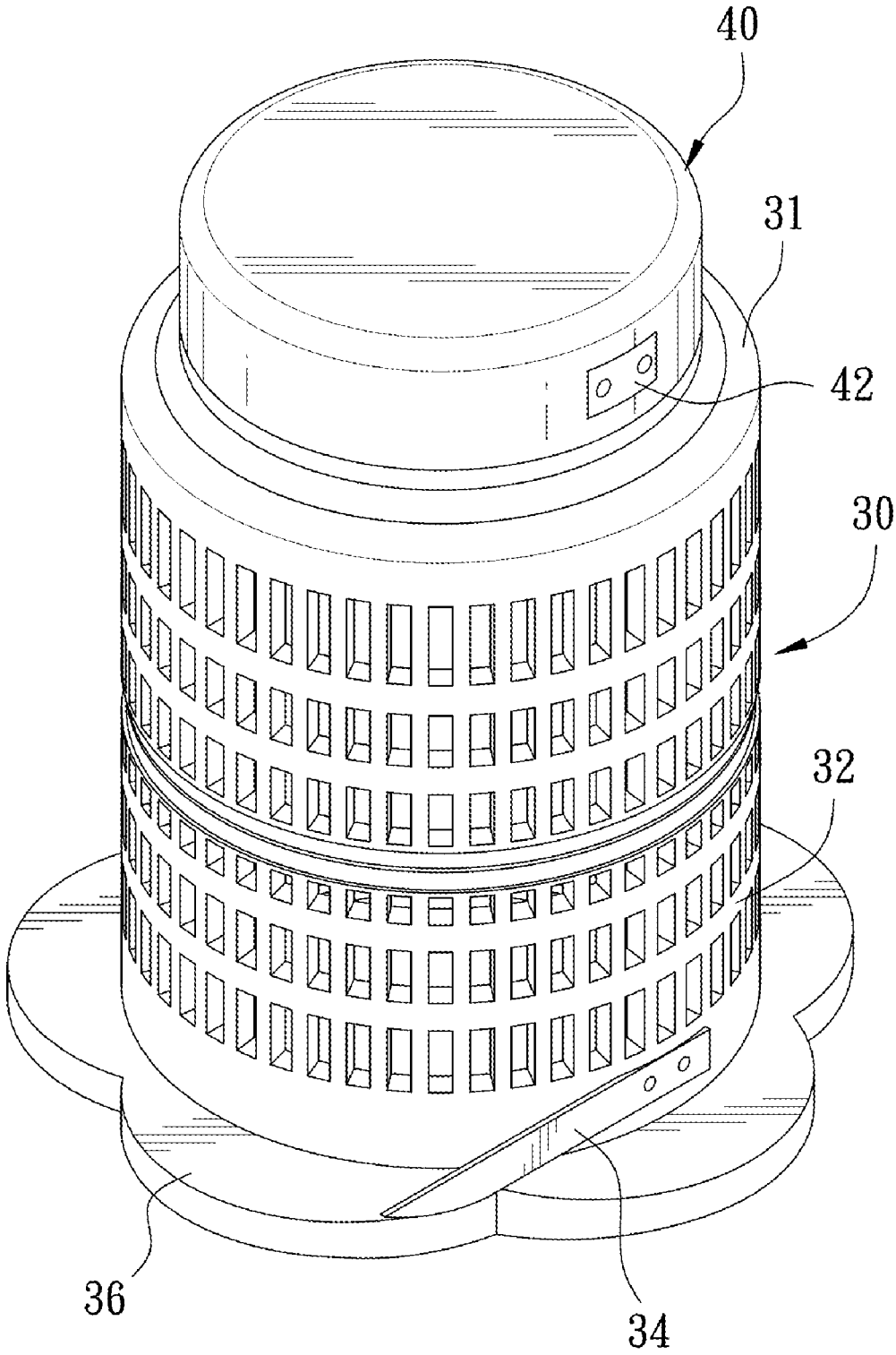
FIG. 6 is a 3D assembly view of a further embodiment of this invention.

With reference to FIG. 6 shown as a 3D assembly view of a further preferred embodiment of this invention, an outer disk cover 36 is spirally fixed to the outer circumference of a lower part of the lower insulation cover 32 of insulation cover 30. The outer disk cover 36 is in the form of a petal and thus the lamp according to this invention is diverse.

Figure 7:
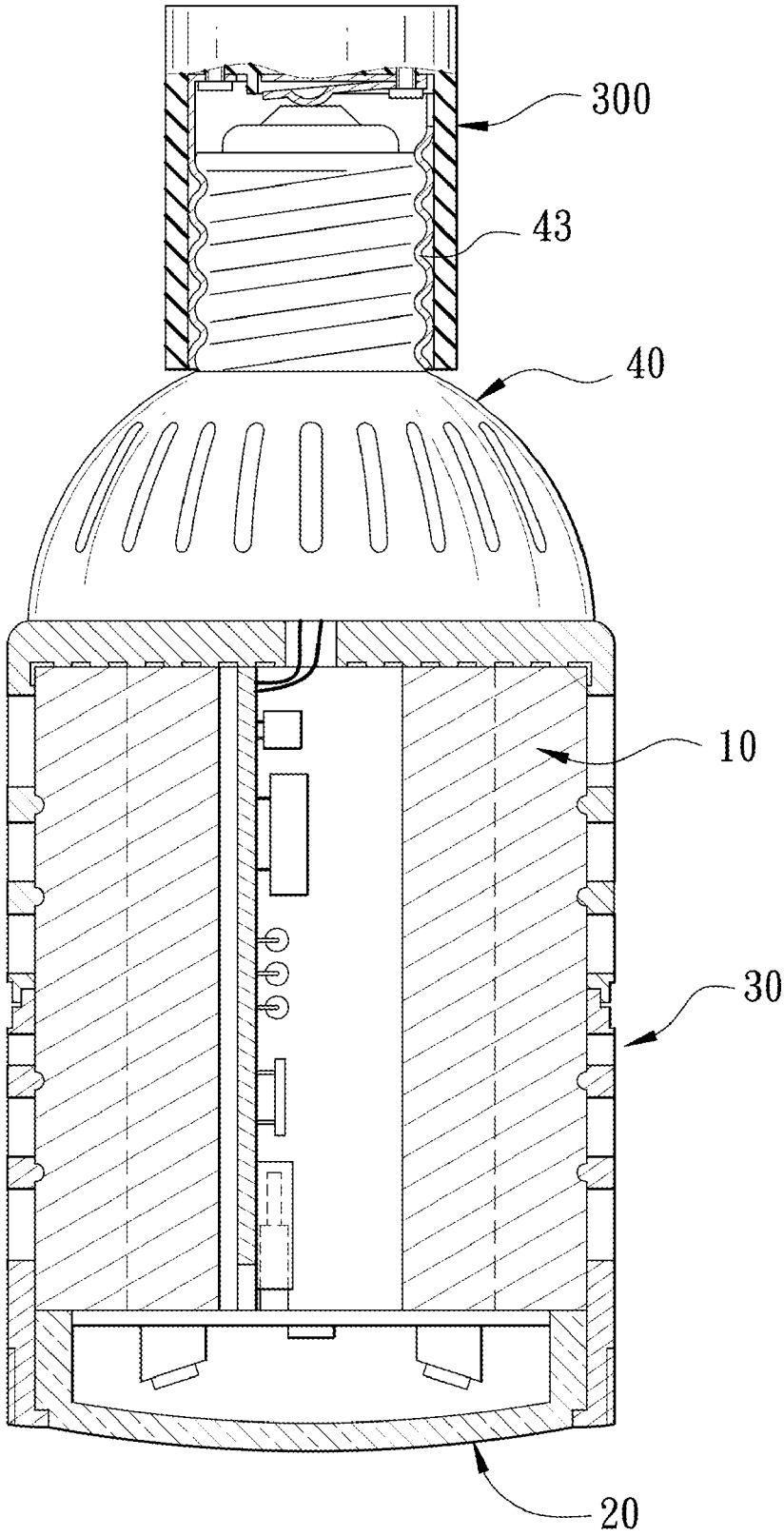
FIG. 7 is a schematic view illustrating the lamp according to this invention that is applied to a lamp bulb mount.

Next, with reference to FIGS. 6 and 7 respectively shown as a 3D assembly view of a further preferred embodiment of this invention and as a schematic view illustrating the lamp according to this invention applied to a lamp bulb mount, the top of extension cover 40 according to this invention may be changed into a universal spiral connector 43 for a lamp bulb mount so that the lamp according to this invention may be spirally fixed onto a general lamp bulb mount 300. Next, the outer disk cover 36 is removed so that the lamp according to this invention may herein be used as a lamp bulb.

Figure 8:
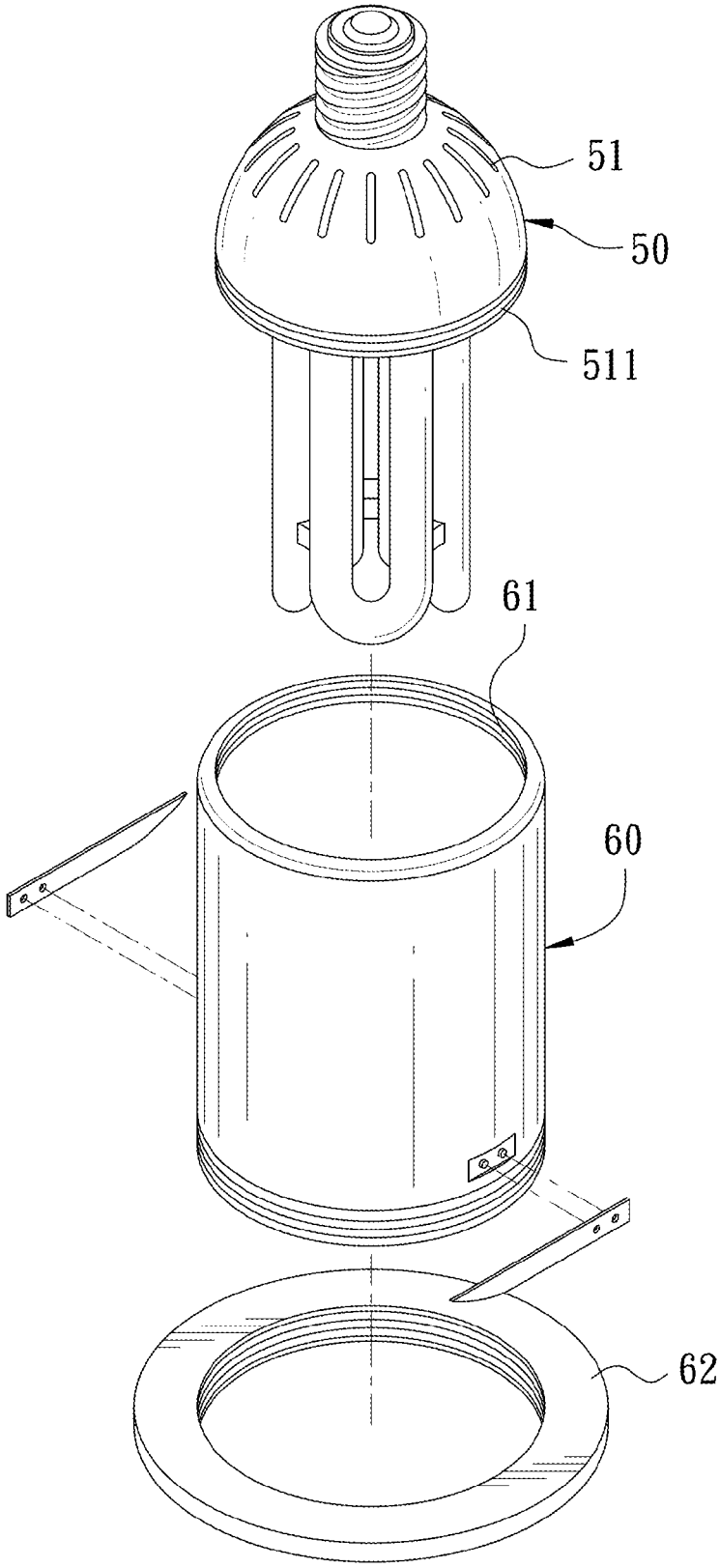
FIG. 8 is a schematic view illustrating the lamp according to this invention that is applied to an energy-saving lamp bulb.

Next, with reference to FIG. 8 shown as a schematic view illustrating the lamp according to this invention applied to an energy-saving lamp bulb, in this embodiment, a light-source body 50 according to this invention is an energy-saving lamp bulb. The light-source body 50 is provided with a base 51 the exterior of which is formed with outer threads 511 so that the outer circumference of light-source body 50 may be spirally fixed onto the top of an insulation cover 60 with inner threads 61. Further, an outer disk cover 62 is spirally fixed to the outer circumference of the lower part of insulation cover 60.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A combinational inset lamp exempt from a shielding cylinder, being possible to inset to an inset hole of the ceiling and comprising:

a light-source body;

a lamp cover allowing light transmission and being arranged below the light-source body; and an insulation cover being in the form of a hollow cylinder, wrapping around the outer circumference of a cylindrical heat-dissipation part; said heat-dissipation part wrapping around said light source body, and clamping the lamp cover, in which an outer disk cover removable and replaceable is provided outwards and transversally in the insulation cover around the outer circumference of the lower part of lower insulation cover, at least opposite two sides of the outer circumferential wall of insulation cover are respectively formed outwards with an elastic clamping flake that is capable of recovering even if being deformed with an external force, and a space substantially equal to the thickness of ceiling is formed between the elastic clamping flake and the outer disk cover.

2. The combinational inset lamp exempt from the shielding cylinder according to claim 1, wherein the light-source body further comprises:

said heat dissipation part that is metallic and is arranged lengthways in the form of a cylinder, the center of which is formed axially with a rectangular thru hole;

a drive circuit board lengthways mounted into the thru hole of heat dissipation part to drive LEDs; and a LED lamp board that is arranged transversally on a side below the heat dissipation part and comprises a substrate connected to a circuit substrate, in which a plurality of LEDs are provided on the substrate.

3. The combinational inset lamp exempt from the shielding cylinder according to claim 2, wherein the thru hole of heat dissipation part is rectangular and formed axially with four sidewalls two opposite sidewalls of which are formed axially with a concave wedge slot to wedge the two sides of the drive circuit board into the wedge slot.

4. The combinational inset lamp exempt from the shielding cylinder according to claim 2, wherein the insulation cover is assembled with an upper insulation cover and a lower insulation cover, the upper insulation cover wraps around the upper section of heat dissipation part from top to bottom, a flange is provided around the outer circumference of lower section, the lower insulation cover wraps around the lower section of heat dissipation part from bottom to top, and a groove is arranged around the inner side of the circumference of lower section opposite to the flange of upper insulation cover.

5. The combinational inset lamp exempt from the shielding cylinder according to claim 2, wherein a plurality of annular grooves are formed in a radial direction around the outer circumference of heat dissipation part and a plurality of annular flanges opposite to the annular grooves are formed at the inner wall of insulation cover for clamping.

6. The combinational inset lamp exempt from the shielding cylinder according to claim 2, wherein a top plate is transversally arranged at the top of insulation cover that is opposite to the top side of heat dissipation part to prevent the top side of heat dissipation part from being exposed for achievement of insulation and an outgoing line hole is formed on the top plate the bottom side of which is formed with a plurality of lugs.

7. The combinational inset lamp exempt from the shielding cylinder according to claim 1, wherein the lamp cover is formed into a mouth facing upwards, a round cover formed with an annulus wall, and allows light transmission, an optics curved surface is formed at the bottom side of lamp cover, a shoulder region is formed around the outer circumference of root edge of the cover, and a convex shift limit flange is provided at the shoulder region of lamp cover that is opposite to the root edge of inner circumferential wall of the insulation cover to resist the shoulder of lamp cover and thus prevent the lamp cover from shifting.

8. The combinational inset lamp exempt from the shielding cylinder according to claim 1, wherein the lamp further comprises an extension cover wedged onto the top of upper insulation cover, and a chamber is provided in the extension cover.

9. The combinational inset lamp exempt from the shielding cylinder according to claim 8, wherein one side of the extension cover is formed into a universal spiral connector for a lamp bulb mount so that the extension cover may be spirally fixed onto the general lamp bulb mount.

10. The combinational inset lamp exempt from the shielding cylinder according to claim 1, wherein each of the elastic clamping flakes is a metallic elastic flake one end of which is a fixed end fixed in the direction of tangent onto the insulation cover and the other end of which is a free end, and the bottom of each of the elastic clamping flakes is convergent from the fixed end towards the free end.

* * * * *